United States Patent [19]

Cazaux

[11] Patent Number: 4,644,997

[45] Date of Patent: Feb. 24, 1987

[54] APPARATUS FOR CONTROLLING THE OSCILLATIONS OF A CONTINUOUS POUR INGOT MOLD

[75] Inventor: Joel Cazaux, Chelles, France

[73] Assignee: Fives-Cail Babcock, Paris, France

[21] Appl. No.: 765,687

[22] Filed: Aug. 15, 1985

[30] Foreign Application Priority Data

Aug. 29, 1984 [FR] France ..... 84 13340

[51] Int. Cl.[4] ..... B22D 11/04; B22D 27/08

[52] U.S. Cl. ..... 164/416; 164/478; 366/128

[58] Field of Search ..... 164/416, 478; 366/128

[56] References Cited

U.S. PATENT DOCUMENTS 3,523,571 8/1970 Niskovskish et al. ..... 164/416
3,672,436 6/1972 Wognum et al. ..... 164/478 X
4,480,678 11/1984 Cazaux et al. ..... 164/416

FOREIGN PATENT DOCUMENTS 2529114 12/1983 France ..... 164/416
51-44518 4/1976 Japan ..... 164/416

*Primary Examiner*—Nicholas P. Godici
*Assistant Examiner*—J. Reed Batten, Jr.
*Attorney, Agent, or Firm*—Kurt Kelman

[57] ABSTRACT

There is provided an apparatus for controlling the oscillations of a continuous pour ingot mold which comprises at least one eccentric having a sleeve with an eccentric boring mounted to rotate on an off-center portion of a shaft. In order to eliminate the drawbacks resulting from the existence of a play between the sleeve and the shaft, the sleeve is so clamped on an off-centered shaft portion as to cancel the clamping constraints to allow the rotation of the sleeve on the shaft when the eccentricity is to be adjusted.

5 Claims, 4 Drawing Figures

APPARATUS FOR CONTROLLING THE OSCILLATIONS OF A CONTINUOUS POUR INGOT MOLD

The present invention relates to an apparatus for controlling the oscillations of a continuous pour ingot mold which comprises at least one eccentric consisting of an eccentrically bored sleeve mounted to revolve about the off-center portion of a shaft. Such a device is shown and described in U.S. Pat. No. 4,480,678, to Cazaux et al., granted Nov. 6, 1984, the description of which is incorporated herein by reference. Usually, the sleeve is fixed or fastened to the shaft by means of a coupling, for example of the geared type, so that it is possible to separate these two parts in order to permit the sleeve to rotate on the shaft so that the eccentricity, and hence the amplitude of the oscillations, can be adjusted.

To permit rotation of the sleeve on the shaft when the eccentricity is being set, it is necessary to provide some play between the two parts. As a result of this play, a deterioration of the contact surfaces of the shaft and the sleeve (fretting) occurs during operation. This deterioration of the contact surfaces locks the sleeve on the shaft and makes any adjustment impossible.

It is the object of the present invention to eliminate locking of the sleeve on the shaft as a result of deterioration of the contact surfaces therebetween by eliminating the play between the sleeve and the shaft.

This object is accomplished according to the present invention by providing a control mechanism wherein the sleeve is fixed on the shaft by clamping means which are designed to be released so as to allow the rotation of the sleeve on the shaft when the eccentricity is to be adjusted.

The sleeve can be fixed on the shaft by means of two clamps which clamp the ends of the sleeve on the shaft. Such a clamp can consist of a biconic collar having two opposing conical or tapered surfaces, two rings, each mounted on a respective conical surface of the collar and clamping means serving to bring the two rings together to thereby contract the collar radially.

The dimensions of the sleeve and of the shaft can also be chosen so that the sleeve is held on the shaft by its own elasticity, means then being provided to inject a fluid under pressure between the shaft and the sleeve in order to expand the sleeve and enable its rotation with respect to the shaft. Also, a bushing may be placed between the shaft and the sleeve, the bushing and sleeve having complementary conical or tapered surfaces, with means being provided to inject a fluid under pressure between the bushing and the shaft.

In the case of a mechanism comprising several eccentrics according to the present invention and driven by the same motor, all the eccentrics can be simultaneously and quickly adjusted by locking the sleeves of all the eccentrics by means of an appropriate tool and turning all the shafts through the desired angle by means of the drive motor or an auxiliary motor.

Other objects and features of the present invention will become apparent from the following detailed description considered in connection with the accompanying drawings. It is to be understood, however, that the drawings are designed as an illustration only and not as a definition of the limits of the invention.

In the drawings wherein similar reference characters denote similar elements throughout the several views.

Figure 1:
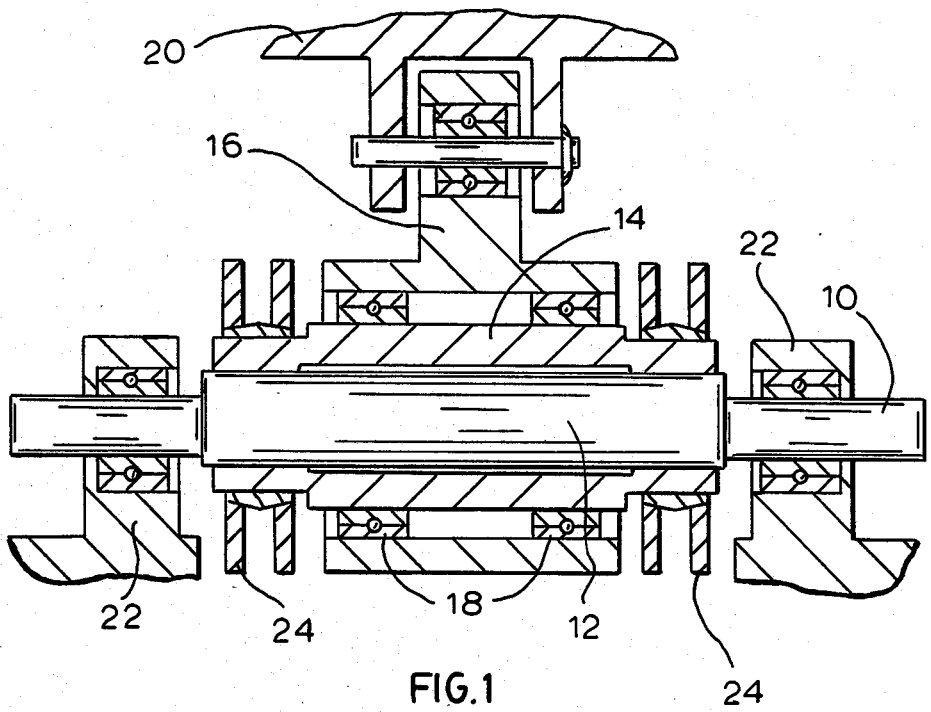
FIG. 1 is a vertical transverse cross-section of a mechanism for controlling the oscillations of a continuous pour ingot mold according to the invention.

Now turning to the drawings, FIG. 1 shows a mechanism which consists essentially of a horizontal shaft 10 comprising an off-centered portion 12 on which is mounted an eccentrically bored sleeve 14 and a connecting rod 16 whose foot is mounted, through rollers 18, on sleeve 14. The head of rod 16 is articulated on table 20 which carries the ingot mold or it may be articulated on the end of a lever connected to the table. Shaft 10 is supported at its ends by bearing 22 and is driven in rotation by a motor-reducer unit (not shown).

Figure 2:
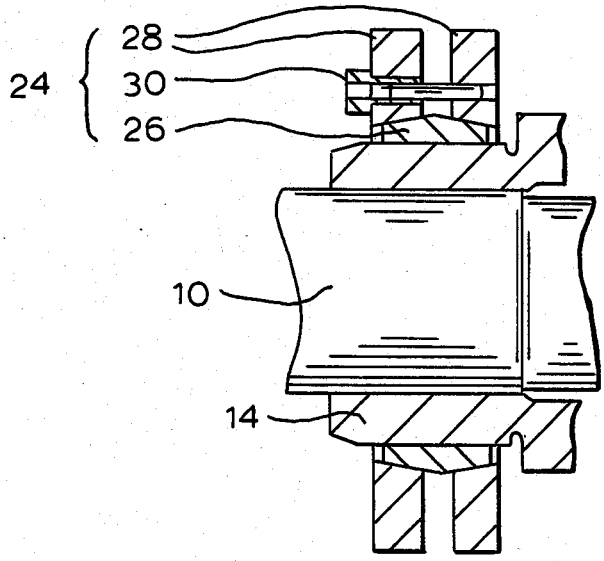
FIG. 2 is an enlarged detail of the mechanism of FIG. 1.

Sleeve 14 is fixed onto shaft 10 by means of clamps 24 which clamp its ends on the offset portion 12 of the shaft. As can be seen in FIG. 2, each clamp is comprised of a collar 26, whose peripheral surface is formed by two truncated cones joined at their large base to form opposing tapered surfaces, and by two rings 28 whose inner faces have the same conical shape or taper as the surfaces of the collar and are mounted on the two halves of the collar. After collars 26 are set in place on the ends of sleeve 14 and the rings 28 are assembled, screws 30 serve to bring the two rings together, which causes an elastic deformation of the collars and, simultaneously, the restriction of the ends of the sleeve on shaft 10, after the assembly slack has been absorbed.

When it is desired to change the amplitude of the oscillations, screws 30 are loosened and sleeve 14 and collars 26 then resume their original dimensions. These dimensions have been so chosen that sufficient play exists between the sleeve and the off-centered portion of the shaft to permit the relative rotation of these two parts. To set the eccentricity to its new value, it suffices therefore to turn the sleeve on the shaft. After setting, the sleeve is locked in its new position by means of clamps 24.

Figure 3:
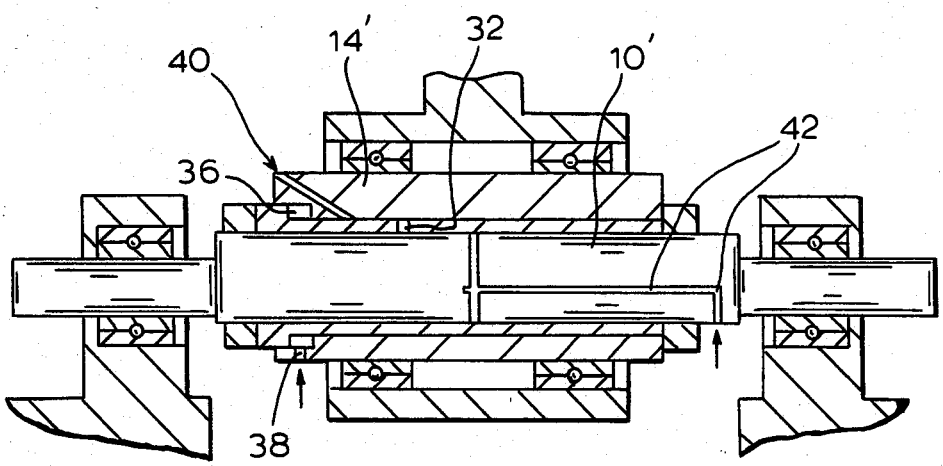
FIG. 3 is a cross-sectional view similar to FIG. 1, showing part of the mechanism and illustrating another means of securing the sleeve on the shaft.

The securing of the sleeve on the shaft can be obtained differently, for example as illustrated in FIG. 3 of the drawings. In this embodiment, a bushing 32 is placed between sleeve 14' and the off-centered portion of shaft 10'. The inner surface of this bushing is cylindrical and its outer surface is slightly conical or tapered, the bore of the sleeve being machined with the same taper. At its larger diameter end, the bushing comprises a small collar which fits by light friction in a recess machined in the corresponding end of the sleeve so as to form an annular chamber 36 which is connected to a source of oil under pressure through a channel 38. Channels 40 pierce sleeve 14' and open onto its inner surface to allow the passage of oil under pressure between sleeve 14' and bushing 32. Channels 42 pierce shaft 10' to allow oil under pressure to be admitted between it and bushing 32.

After having assembled the parts, oil under high pressure is injected through channels 40 between the sleeve and the bushing. This has the effect of radially expanding sleeve 14' so as to allow the axial movement of the sleeve with respect to the bushing. Simultaneously, low pressure oil is admitted to chamber 36 to move the sleeve and bring it to a predetermined position corresponding to the desired degree of tightness. When the supply of oil under pressure is interrupted, the sleeve tends to resume its original dimensions and thus clamps bushing 32 on shaft 10', which serves to fix these three parts.

To set the eccentricity, high pressure oil is injected through the channels 42 between the shaft and the bushing. This has the effect of expanding the bushing and the sleeve and to allow the rotation of this assembly with respect to the shaft. After adjustment, the supply of oil under pressure is interrupted and the bushing-sleeve assembly once more clamps down on the shaft.

Figure 4:
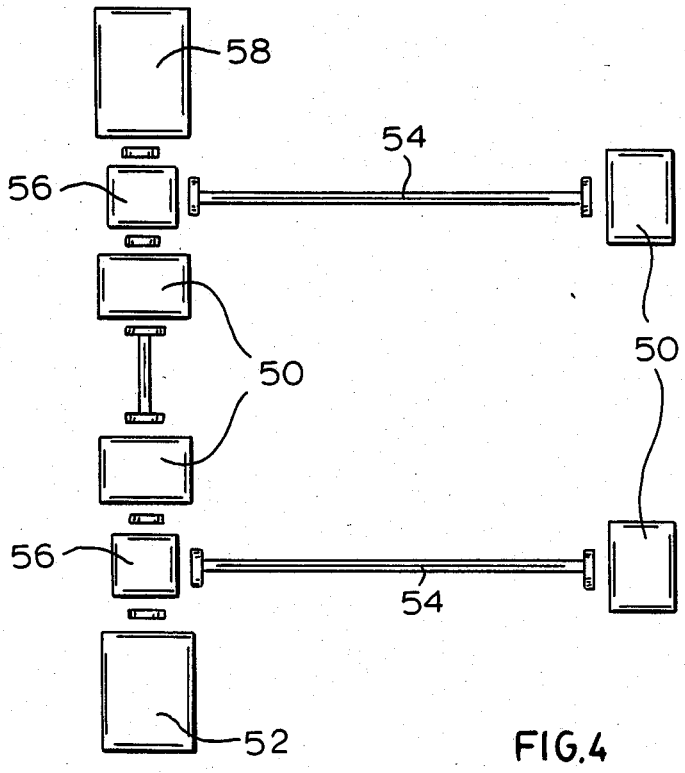
FIG. 4 is a schematic diagram of a mechanism with four eccentrics.

The mechanisms controlling the oscillations of a continuous pour ingot mold may include several eccentrics driven synchronously by a single motor. FIG. 4 shows, for example, a mechanism with four eccentrics 50 whose shafts are coupled to a motor 52 through extensions 54 and cranks 56. As a result of the mounting according to the present invention, it is possible to simultaneously and very quickly adjust all the eccentrics. For this, it suffices to lock the sleeves of the four eccentrics for example by means of a wrench and, after having loosened the sleeves from the shafts, to turn these through the desired angle by means of the motor 52 or by means of an auxiliary control motor 58.

While two embodiments of the present invention have been shown and described, it will be obvious that many changes and modifications may be made thereunto without departing from the spirit and scope of the invention.

What is claimed is:

1. In an apparatus for controlling the oscillations of a continuous pour ingot mold having at least one eccentric consisting of an eccentrically bored sleeve and a shaft fixed together in rotation, the improvement comprising a clamping means for fixing the sleeve on an off-centered portion of the shaft and means for cancelling the clamping constraints to allow the rotation of the shaft with respect to the sleeve to adjust the eccentricity.

2. The apparatus as defined in claim 1, wherein several eccentrics driven by a single motor are provided, and which further comprises means to lock in rotation the sleeves of all the eccentrics and means to simultaneously rotate all the shafts of the eccentrics.

3. The apparatus as defined in claim 1, wherein the sleeve is fixed on the off-centered shaft portion by means of two clamps which clamp the ends of the sleeve on the off-centered shaft portion, each clamp comprising a biconic collar having two opposing tapered peripheral surfaces, two rings each mounted on a conical part of said collar, and tightening means for bringing the rings together so as to contract the collar radially.

4. The apparatus as defined in claim 1, wherein the dimensions of the sleeve and of the off-centered shaft portion are such that the sleeve is tightened on the off-centered shaft portion by its own elasticity, and further comprising means for injection of fluid under pressure between the sleeve and the off-centered shaft portion so as to expand the sleeve and allow its rotation with respect to the shaft.

5. The apparatus as defined in claim 4, which further comprises a bushing disposed between the off-centered shaft portion and the sleeve, said bushing and said sleeve having complementary tapered surfaces, and wherein said fluid injection means inject a fluid under pressure between said bushing and said off-centered shaft portion.

* * * * *